United States Patent [19]

Barreiro et al.

[11] 4,424,136

[45] Jan. 3, 1984

[54] LITHIUM GREASE CONTAINING PARAFFINIC OILS

[76] Inventors: Eduardo M. Barreiro, Burzaco; Pedro El Juri, Buenos Aires, both of Argentina

[21] Appl. No.: 385,307

[22] Filed: Jun. 4, 1982

[30] Foreign Application Priority Data

Jun. 4, 1981 [AR] Argentina ..... 285588

[51] Int. Cl.[3] ..... C10M 5/14

[52] U.S. Cl. ..... 252/41; 252/18; 252/42.1

[58] Field of Search ..... 252/41, 18, 42.1

[56] References Cited

U.S. PATENT DOCUMENTS

| | | | |
|---|---|---|---|
| 2,455,892 | 12/1948 | Fraser | 252/41 |
| 2,813,829 | 11/1957 | Woods et al. | 252/41 |
| 2,826,549 | 3/1958 | Manleuffel et al. | 252/42.1 |
| 3,103,493 | 9/1963 | Groszek et al. | 252/41 |

*Primary Examiner*—Jacqueline V. Howard

*Attorney, Agent, or Firm*—Scully, Scott, Murphy & Presser

[57] ABSTRACT

A lithium grease containing paraffinic oils, thickeners, lithium compounds and crystallization modifiers is provided.

1 Claim, No Drawings

LITHIUM GREASE CONTAINING PARAFFINIC OILS

BACKGROUND OF THE INVENTION

It is known to use oils derived from naphthenic crude petroleums, oils whose viscosity index ranges between 35 and 80, to produce lithium greases.

The reasons for the use of these naphthenic fractions may be summarized as follows:

1. Low Soap Content

The lithium greases produced with naphthenic fractions have low soap contents, ranging between 8 and 12%, for a consistency grade of II NLGI. As the lithium soap is the most expensive component, the economic advantages are obvious. Moreover, it is advantageous to have a grease with a low soap content because its rheological behavior tends to be newtonian and, therefore, the grease is pumpable.

2. Low Tendency of Oil Separation

After being stored for a certain time, oil has a tendency to separate from the grease and floats. Said tendency is called "bleeding". Unlike paraffinic fractions, naphthenic fractions have very low bleeding characteristics.

3. Good Mechanical Stability

The mechanical stability of a grease is a parameter which is measured by standardized methods (ASTM D-217) and they represent the resistance of the crystal structure to shear; also, it is an indirect measure of the capacity of structure recovery when the shear ceases (rheopexy). Said resistance is a function of the crystal structure and of the oil; when using naphthenic oils the resistance is found to be much greater than if paraffinic oils are used.

Another influential factor is the viscosity of the oil used. By experimentation, it has been found that the best greases are obtained with oils of a viscosity between 700 and 900 S.S.U. at 37.8° C. The use of lighter fractions, even if naphthenic, involves loss of yield or increase of the percentage of soap, while the use of heavier fractions lessens the quality of the product since the soap tends to form separate granules which are difficult to disperse. The main disadvantage of the use of naphthenic fractions is their scarcity at the national and international level and, hence, their high cost.

Thus, it would be advantageous to produce greases by using paraffinic fractions. However, the use of paraffinic fractions normally results in greases of very low resistance in working towards equal percentages of soap.

Numerous prior attempts to incorporate paraffinic fractions of high viscosity index have not lead to products of either good yield or of good profitability.

The disadvantages associated with lithium greases formulated with these oils are:

1. High soap content (higher than 20%).
2. Inferior fluid dynamic properties (they are greases which tend to be more non-newtonian), which makes them non-pumpable.
3. Great (higher than 15%) oil separation (bleeding).
4. Low resistance to working.
5. Poor appearance (opaque and granular).

6. High operating cost and not profitable due to the high soap content.

In the literature on production of lubricating greases numerous references are found concerning the influence of the oil.

For example, Boner, in his book "Modern Lubricating Greases", Scientific Publications, G.B. (1976), states at p. 6.2" . . . from the viewpoint of obtaining the soap and of obtaining the most desirable crystal lattice, the oils of low or moderate viscosity index are preferable . . . ". He also shows a graph (p. 6.3) of the effect of the viscosity index and the viscosity of the oil on the soap content of the grease that is obtained, and of fixed penetration (220) (p. 6.3). It is noted that the possibility of obtaining lubricating greases by using paraffinic oils of a viscosity index higher than 93 is not even mentioned.

After numerous experiments, Boner succeeded in setting up a qualitative theoretical model which explains the reasons for the facts previously set forth, and he set out generally the direction to follow for obtaining lithium greases with paraffinic oils.

It is known that grease consists of a microcrystalline fibrous lattice of lithium soap in whose cavities oil is retained. The consistency of the grease is proportional to:

1. Percentage of Soap Contained

If the percentage of soap is increased, pumpability of the grease decreases and the cost of the grease production increases.

2. Raw Materials

The raw materials used for obtaining the soap are also important, as they determine the type and the polarity of the fibers that are obtained.

When hydroxylated or short-chain fatty acids are used, for example, the polarity of the lattice is greater than if the fatty acids are saturated and long-chained.

The polarity of the fibrous lattice is responsible for the bond strength of the lattice with the oil molecules and this bond strength is a function also of the type of oil.

3. Bond Strength Between the Oil and the Lattice

In the case of paraffinic oils where compounds of high polarity do not exist, the bond strength between the oil and the microcrystalline soap lattice is weak. This is the main reason why it is not possible to obtain greases of good quality when using this type of oil in the formulation.

DESCRIPTION OF THE INVENTION

To obtain a grease of good quality, a series of crystallization-improving additives has been discovered, the effects of which are twofold:

A. They increase the polarity of the fibrous lattice.

B. They increase the polarity of the oil.

When this increase in polarity occurs, the bond strength between the lattice and the oil increases, and products of excellent final quality are obtained.

It should be made clear that this effect is the consequence of a synergic action of increase of both polarities; to increase only one of them does not lead to positive results.

Increase of the Polarity of the Fibrous Lattice

The polarity of the microfibers of soap is a function of the type of oil used to obtain it.

The fatty acids that give good polarity are the mono- or poly-hydroxylated and/or unsaturated ones; but they have the disadvantage of being high-priced.

The low-priced fatty acids, like stearic acid, oleostearine, tallow, etc., have the disadvantage of not giving good polarity.

It has been discovered that by adding in small portions pertoleum derivatives called "Naphthenic Acids" to a fatty acid of low polarity, the crystal system obtained has a high polarity, and is apt to give greases of good yield.

Increase of the Polarity of Paraffinic Oil

Paraffinic oil has no polar compounds, as they have been partially or totally eliminated during the production processes. These processes result in a lubricant of excellent characteristics for the use for which they are intended, as crankcase lubricants, but of very bad characteristics for use in lubricating greases.

It has been discovered that by adding certain compounds of aromatic and/or naphthenic characteristics to these paraffinic oils their polarity is increased, and by combining this with the increase in polarity of the lattice mentioned before, a synergetic effect is produced resulting in greases of excellent quality.

Characterization of the Crystallization Modifiers

Crystallization modifiers are, as has been said above, modifiers of the crystal lattice and of the oil.

Lattice Modifiers

They consist of naphthenic acids derived from petroleum (mineral acids) which modify the polarity of the microcrystalline system; chemically they are not specific compounds, but mixtures. They are characterized by a series of standardized analyses, whose ranges claimed in this invention, and their preferred ranges, are described below:

| ANALYSIS | STANDARD | RANGE CLAIMED | PREFERRED RANGE |
|---|---|---|---|
| Density | ASTM D1298 | 0.700–1.100 | 0.900–1.000 |
| Viscosity at 37.8° C. SSU | ASTM D445 | 20–1,500 | 80–200 |
| Viscosity at 98.9° C. SSU | ASTM D445 | 5–300 | 20–70 |
| Index of refraction at 20° C. | | 1.300–1.600 | 1.420–1.520 |
| Total acidity No. | ASTM D664 | 50–350 | 180–280 |
| K UOP Factor | — | 9.11.8 | 9.8–108 |
| Molecular weight | — | 80–380 | 160–280 |
| Distillation curve | ASTM D1160 | First drop 40–300<br>50% 100–400<br>50% 150–520 | 160–240<br>250–350<br>300–380 |

These naphthenic acids enter in the formulation of the grease in a low percentage by weight.

The claimed range is from 0.01% to 5% expressed as % by weight referred to the total weight of the grease. The preferred range is from 0.1% to 1%.

Polarity Modifiers of the Oil

The polarity modifiers of the oil are derivatives of two families: (1) Alkyl ($C_7$–$C_{20}$) benzenes and (2) aromatic extracts.

The former are by-products of petrochemical plants for the production of alkyl-benzenes which subsequently sulfonated are known as "synthetic detergents." They are a heterogenous mixture of mono- and poly-alkylated compounds, with side chains of 7 to 20 carbon atoms, branched and linear. They are characterized by a series of analyses, whose claimed and preferred ranges are described below:

| ANALYSIS | STANDARD | RANGE CLAIMED | PREFERRED RANGE |
|---|---|---|---|
| Density | ASTM D-1298 | 0.78–0.95 | 0.83–0.50 |
| Viscosity at 37.8° C. | ASTM D-445 | 20–280 | 40–90 |
| Viscosity at 98.9° C. | ASTM D-445 | 10–130 | 25–60 |
| Index of refraction at 20° C. | — | 1.420–1.600 | 1.450–1.530 |
| K UOP Factor | — | 10.5–12.2 | 11–11.95 |
| Molecular weight (Calculated) | — | 100–400 | 260–350 |
| Distillation curve | ASTM D-1160 | First drop 120–290<br>50% 200–380<br>50% 300–450 | 190–260<br>240–350<br>400–480 |

The percentage by weight based on the total weight of grease is low, its claimed range being from 0.01 to 10% and the preferred from 0.1 to 1%.

The aromatic extracts are by-products of plants for extraction of lubricating oils with furfural. Normally they do not have a specific use, being sent to Fueloil or as charge of catalytic cracking. Chemically they are a complex mixture of aromatic and naphthenic mono- and poly-nucleated derivatives, with or without alkylic side chains, asphaltenes, etc.

They are characterized by a series of analyses whose claimed and preferred ranges are listed below:

| ANALYSIS | STANDARD | RANGE CLAIMED | PREFERRED RANGE |
|---|---|---|---|
| Density | ASTM 1298 | 0.88–1.05 | 0.93–1.00 |
| Viscosity at 37.8° C. SSU | ASTM D-445 | 800–10,000 | 2,500–7,500 |
| Viscosity at 98.9° C. | ASTM D-445 | 30–200 | 80–150 |
| Index of refraction at 20° C. | — | 1.450–1.620 | 1.500–1.580 |
| K UOP Factor | — | 10–11.8 | 10.5–11.5 |
| Molecular weight (Calculated) | — | 250–500 | 350–450 |
| Distillation curve | ASTM D-1160 | First drop 200–450<br>50% 300–520<br>50% 350–550 | 350–400<br>420–500<br>450–530 |

The claimed range expressed in percentage by weight goes from 0.01% to 10%, the preferred being from 0.1% to 2% by weight based on the final grease.

As mentioned earlier, the previous literature does not contain data on the production of lithium greases with paraffinic oils. The oils utilized in the present invention, are normally used in the production of crankcase motor oils, and are characterized by the following analyses:

Density: Higher than 0.850
Visc. at 37.8° C.: Higher than 100 SSU
Visc. at 98.9° C.: Higher than 30 SSU
Visc. Index: Higher than 93
K UOP Factor: Higher than 12.1
Color: Lower than 5
Aniline point: Higher than 95° C.

The raw materials for the production of the lithium soap of this invention are the following:

A. Sources of Fatty Materials

Saturated or unsaturated fatty acids, whether hydroxylated or not, derived from tallow or vegetable sources, or synthetic; esters of said fatty acids and their combinations with those mentioned.

B. Sources of Lithium

Oxide, hydroxide, and organo-metallic compounds of lithium.

In order to describe more fully the nature of the present invention, specific examples will hereinafter be described. It should be understood, however, that this is done solely by way of example and is intended neither to delineate nor limit the ambit of the appended claims.

EXAMPLES

EXAMPLE No. 1

| Grease Grade NLGI No. 2 Composition of the charge | | % by weight based on grease obtained |
|---|---|---|
| Oleostearine | 450 kg | 8.36 |
| Monohydrated lithium hydroxide | 82.5 kg | 1.53 |
| Naphthenic acids | 35 kg | 0.65% |
| Aromatic extracts | 250 kg | 0.46% |
| Alkylbenzenes | 15 kg | 0.28% |
| Paraffinic acid | 4792 kg | 89.1% |
| Losses | 20 kg | |
| Total | 5380 kg of grease | |
| % of soap | 10.5% | |

With this batch composition, the normal production process was used, 5,380 kg of grade NLGI 2 grease being obtained; this grease is known under the commercial code YPF Lithium Grease 62, complying with all commercial specifications.

EXAMPLE No. 2

Production of extreme pressure Lithium Grease grade NLGI 2.

| Batch Composition | | % by Weight |
|---|---|---|
| Hydrogenated Castor Oil | 225 kg | 4.13 |
| Stearic Acid 12 OH | 225 kg | 4.13 |
| Lithium Hydroxide | 84 kg | 1.54 |
| Naphthenic Acids | 25 kg | |

-continued

Production of extreme pressure Lithium Grease grade NLGI 2.

| Batch Composition | | % by Weight |
|---|---|---|
| Aromatic Extracts | 25 kg | 0.46 |
| Alkylbenzenes | 12.5 kg | 0.23 |
| Paraffinic Oil | 4.783 kg | 87.76 |
| EP Additives | 50 kg | 0.91 |
| Losses | 20.5 kg | |
| Total | 5.450 kg of Grease | |
| Percentage of Soap | 10.25% | |

With this batch composition 5,450 kg of extreme pressure grease grade NLGI: 2 were obtained, with the commercial code YPF Lithium Grease 62 EP fulfilling all commercial specifications.

EXAMPLE No. 3

Production of extreme pressure Lithium Grease grade NLGI 3

| | | |
|---|---|---|
| Stearic Acid | 250 kg | 4.82% |
| Oleostearine | 250 kg | 4.82% |
| Lithium Hydroxide | 92 kg | 1.77% |
| Naphthenic Acids | 30 kg | 0.58% |
| Aromatic Extracts | 30 kg | 0.58% |
| Alkylbenzenes | 20 kg | 0.38% |
| Paraffinic Oil | 4,453 kg | 85.96% |
| Additives | 75 kg | 1.45% |
| Losses | 20 kg | |
| Total | 5,180 kg | |
| % of Soap | 12.0 kg | |

With this batch composition 5,180 kg of grease were obtained in sale specification, with the commercial code YPF Lithium Grease 63 EP.

Lastly it is added that all products obtained with paraffinic, crystallization-improving oils not only meet but in many cases widely exceed the sale specifications of their counter-types obtained with naphthenic oils.

What is claimed is:

1. A lithium grease containing paraffinic oils, thickeners and lithium compounds, which comprises crystallization modifiers consisting of lattice modifiers formed by mineral acids whose viscosity is between 20 and 1500 Seconds Saybolt Universal (SSU) at 37.8° C. and in percentages by weight between 0.01 and 5%, and polarity modifiers of the oil formed by alkyl ($C_7$–$C_{20}$) benzenes with a viscosity of 20 to 280 seconds Saybolt Universal (SSU) at 37.8° C., in percentages by weight between 0.01 and 10%, and aromatic extracts which are residues of extraction with furfural of lubricating oils, of a viscosity between 800 and 10,000 seconds Saybolt Universay (SSU) at 37.8° C., in percentages by weight between 0.01 and 8%.

* * * * *